United States Patent [19]

Baba

[11] 4,009,512

[45] Mar. 1, 1977

[54] METHOD FOR SIZING WARP YARNS

[76] Inventor: Hirohito Baba, No. 12-36, 2-chome, Yamate-cho, Suita, Osaka, Japan

[22] Filed: Sept. 10, 1975

[21] Appl. No.: 611,873

[30] Foreign Application Priority Data

Feb. 27, 1975 Japan ..... 50-24617

[52] U.S. Cl. ..... 28/72.6; 28/28

[51] Int. Cl.[2] ..... D02H 9/00; D02H 5/02

[58] Field of Search ..... 28/28, 57, 72.6, 31, 28/32, 33, 40, 72.5; 242/35.5 R

[56] References Cited

UNITED STATES PATENTS

| | | | |
|---|---|---|---|
| 3,449,808 | 6/1969 | Kuroda | 28/28 |
| 3,744,110 | 7/1973 | Baba et al. | 28/28 |
| 3,789,469 | 2/1974 | Kodama | 28/72.6 |

*Primary Examiner*—Louis K. Rimrodt

[57] ABSTRACT

A method for sizing warp yarns for yarn dyed fabric. It consists of the first operation of arranging cheeses on a cheese creel for a desired pattern and winding the warp yarns from the cheeses to form a warpers beam, and the second operation of sizing and drying the warp yarns from a plurality of the warpers beams thus formed while winding them on a drum, and rewinding the sized yarns to form a loom beam. In both operations, the warp yarns are passed through a lease reed and a lease cord is set at their ends by use of the lease reed. This makes more efficient the sizing of warp yarns.

4 Claims, 8 Drawing Figures

METHOD FOR SIZING WARP YARNS

The present invention relates to an improved method of sizing warp yarns for yarn dyed fabric.

For sizing of warp yarns for yarn dyed fabric having a multicolored, complicated pattern, what is called a sectional warp sizing technique has been employed in which warp yarns from cheeses arranged on a cheese creel for an entire pattern for one section are passed directly through a sizing unit and a drying unit and wound on a drum in a sufficient length to form a required number of sections, and then the sized yarns are rewound all at once to form a loom beam.

In the process of pulling warp yarns from the cheeses on the cheese creel, yarn breakage often occurs. The conventional method in which the warp yarns from the cheese creel are brought directly to a sizing machine is, therefore, time-consuming for tying of broken yarns. Moreover, if any wrong yarns are tied together, yarn breakage will occur again. This results in low efficiency.

At each change of lot, a considerable time is also required for the setting of cheeses on a cheese creel because of the large number of cheeses. This greatly decreases working efficiency particularly for small lot jobs. The present invention solves such shortcomings of the conventional method.

It is an object of the present invention to provide a sizing method in which after warpers beams have been formed on a warping machine, the warp yarns from such warpers beams are subjected to sizing and drying, thereby minimizing yarn breakage during the sizing operation and increasing production efficiency.

It is another object of the present invention to provide a sizing method in which in forming warpers beams, only a number of cheeses sufficient to represent a fraction of a predetermined pattern for one section have to be placed on a cheese creel.

It is a further object of the present invention to provide a sizing method in which warp yarns can be easily passed through a lease reed and easily split into sheets by split rods because a lease cord has been provided beforehand at the end of the yarns on each warpers beam.

It is a still further object of the present invention to provide a sizing method in which after the warp from a plurality of warpers beams have been passed through a sizing unit and a drying unit in overlapped sheets, they are separated by separating rollers into sheets and passed through a lease reed to keep them in position for the fraction of the pattern so that loom beams with a lease cord at each yarn end can be formed.

Other features and advantages of the present invention will become apparent from the following description and the accompanying drawings wherein.

Figure 1:
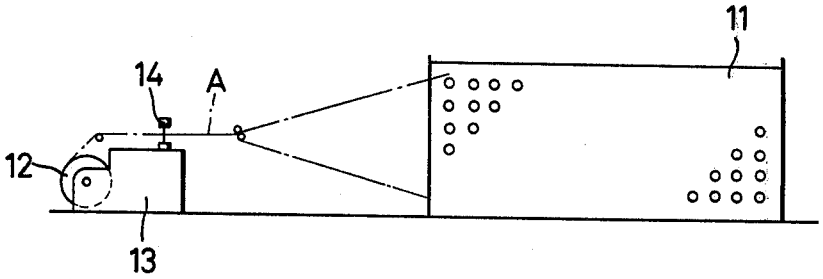
FIG. 1 is a side view of an installation for forming warpers beams used in the method according to the present invention.

Referring to FIG. 1, cheeses are arranged on a cheese creel 11 for a fraction of a predetermined pattern for one section. In front of the cheese creel 11 is installed a warper 13. On the warper 13 is vertically movably mounted a lease reed 14. After passing through the reed 14, the warp yarns A from the cheeses are wound on a beam 12 by means of a guide roller.

A predetermined length of the warp yarns is wound on the beam 12 to form a warpers beam. After the completion of winding thereon, a lease cord 15 is inserted into the ends of the warp yarns by use of the lease reed 14 in such a manner as described below.

Figure 6:
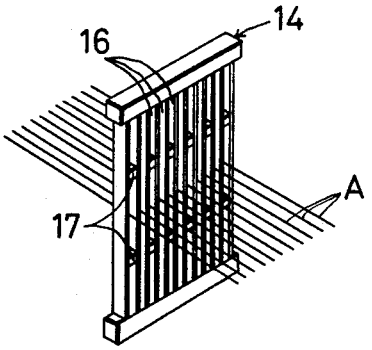
FIG. 6 is a perspective view showing the warp yarns passed through a lease reed in its neutral position.
Figure 7:
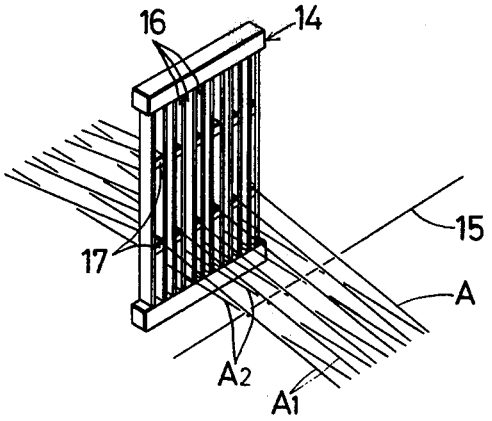
FIG. 7 is a view similar to FIG. 6 with the lease reed in its upper position and a lease cord inserted through the warp yarns only one way.
Figure 8:
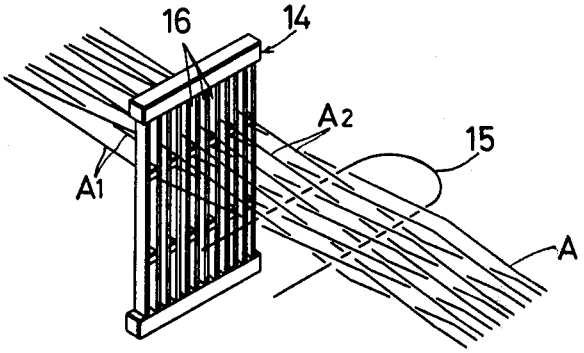
FIG. 8 is a view similar to FIG. 6 with the lease reed in its lower position and the lease cord inserted therethrough one way and back.

The manner of inserting the lease cord 15 is illustrated in FIGS. 6 to 8. The reed 14 has longitudinally elongated spaces 16 formed therein to separate the yarns from one another. The alternate spaces are provided with two stop members 17 attached, as by soldering, one above the other. The yarns run between two stop members 17.

While winding the warp yarns A on the beam 12, the reed 14 is placed in its neutral position as shown in FIG. 6. Just before a predetermined length is reached, winding is stopped and the reed 14 is raised to its upper position as shown in FIG. 7. In this position, the alternate yarns $A_1$ in the spaces 16 provided with the stop members 17 are pulled up while the other yarns $A_2$ remain as they are. Thus a space is formed between these two groups of warp yarns. A lease cord 15 is inserted into the space in a transverse direction.

When the reed 14 is then lowered to its lower position as in FIG. 8, the alternate yarns $A_1$ in the stop containing spaces are pushed down while the other group of yarns $A_2$ remain in the same position, thus again forming a space therebetween. The end of the lease cord 15 is folded back and inserted again into the newly formed spaced. As viewed from side, the yarns A will look as if they are crossing one another between the two places where the lease cord 15 is inserted. This ensures that the yarns are kept in position for a desired pattern or a fraction thereof.

Figure 5:
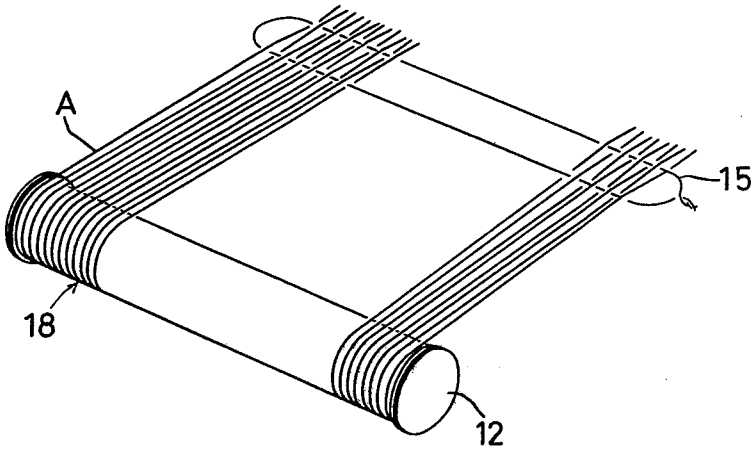
FIG. 5 is a perspective view of a warpers beam formed in the first operation, with a lease cord inserted through the ends of the warp yarns.
Figure 4:
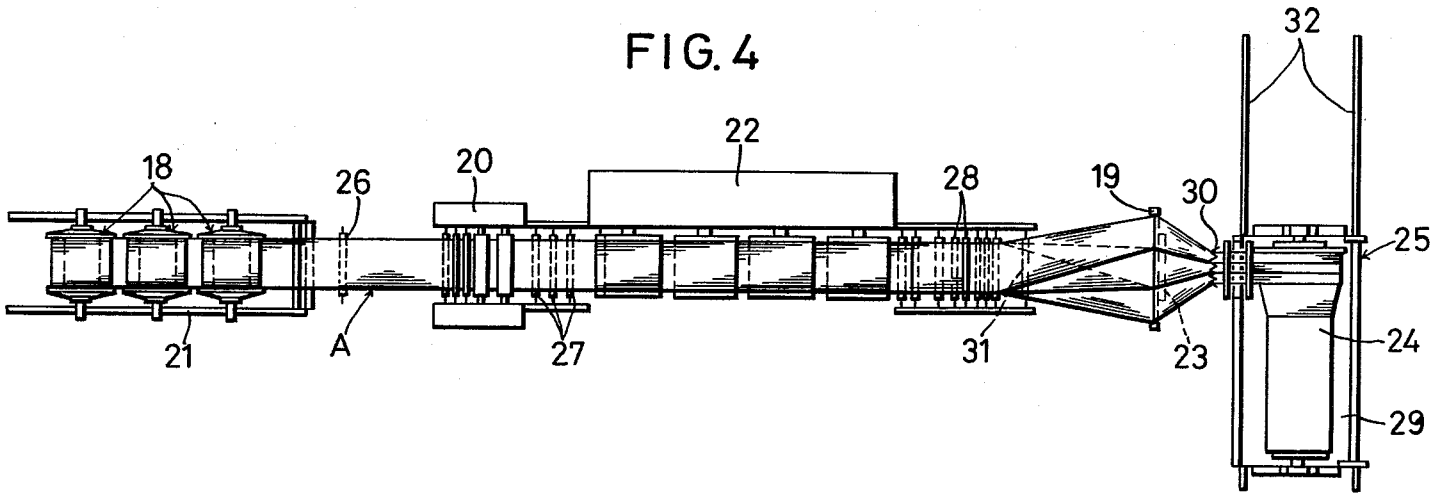
FIG. 4 is a top plan view of the line shown in FIG. 3.

After inserting the lease cord 15, the reed 14 is returned to its neutral position and the yarns are cut between the lease cord 15 and the lease reed 14. The ends of the lease cord 15 are then tied together to form a warpers beam 18 constituted by the yarns wound on beam 12 and the lease cord 15, as shown in FIG. 5.

This completes the first operation and work proceeds to the second operation.

The warpers beam 18 is removed from the warper 13 to a suitable place. The first step of the second operation is to pass the yarn ends from the beam 18 through another lease reed 19 for sizing. This is accomplished either by passing them directly therethrough or by tying the yarn ends to ends of the seed yarns that have been passed therethrough beforehand, by means of a tying machine. The yarns A now extended through the lease reed 19 in order for a fraction of the predetermined pattern.

If yarns are introduced from a plurality of warpers beams, they are passed through the reed 19 into parallel side-by-side relation, the yarns from the first beam through the righthand portion thereof and those from the second one through the middle portion and those from the third one through the lefthand portion, for example.

This step is preferably done on a space beam creel to minimize downtime although it may be done on the beam creel on the production line, of course.

Figure 2:
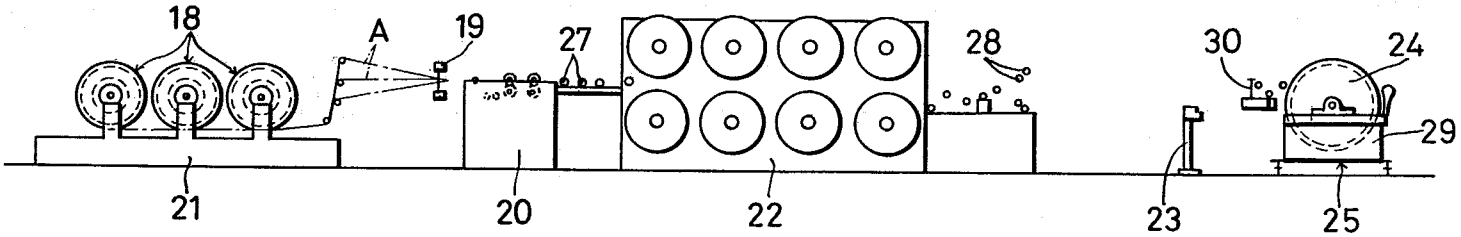
FIG. 2 is a side view of a line for sizing and drying operations, with the warp yarns for the warpers beams on a beam creel passed through a lease reed.

A required number of warpers beams 18 with the yarns therefrom passed through the reed 19 are mounted on a beam creel 21 installed behind a sizing unit 20. FIG. 2 illustrates the yarns from such warpers beams passed through the lease reed 19 for sizing.

In front of the sizing unit 20 are arranged a drying unit 22, separating rollers 28, a reed holder 23, and a winder 25 provided with a winding drum 24, in this order.

The warp yarns A from the beams 18 are pulled out together with the reed 19 and passed by hand through the sizing unit 20, the drying unit 22 and the separating rollers 28. The former two are of a cantilever construction and the rollers 28 and the dividing rods described below are removably for easy passage of the yarns and the reed 19 therethrough or therebetween.

After being passed therethrough, the lease reed 19 is mounted on the reed holder 23 and the yarns A are guided to the drum 24 through a guide reed 30, which is provided to regulate the width of one section to a desired width.

Then, split rods 26, wet dividing rods 27, and front dividing rods 31 are inserted crosswise into the warp sheet in their respective positions by utilizing the lease cord 15.

At the start of winding of the sized and dried yarns on the drum 24, another lease cord 15 is inserted at the ends thereof by use of the lease reed 19 in the aforementioned manner. The yarns A are thus wound on the drum 24 with a lease cord 15 set at their end.

The winder 25 has a drum 24 rotatably supported on a carriage 29 which is adapted to be slidable on a pair of rails 32 in a direction transverse to the yarn running direction.

Figure 3:
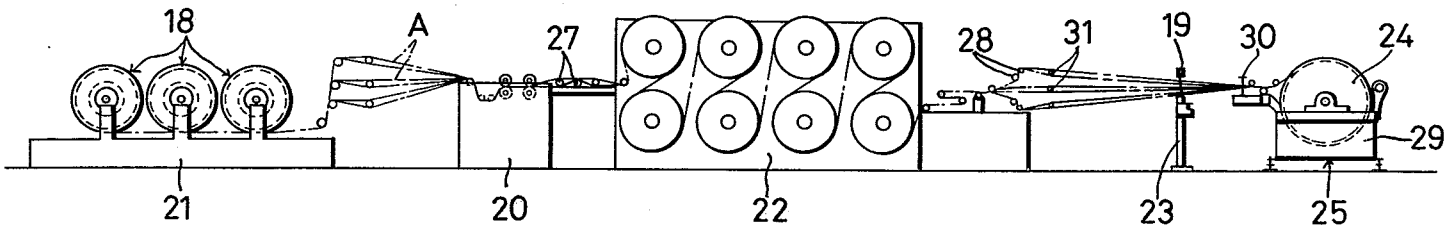
FIG. 3 is another side view thereof, showing the line in operation with the warp yarns passed through the entire line.

FIG. 3 shows the entire line for the second operation which has been completely set up for operation with the end of the warp sheet wound around the drum 24. As the winding drum 24 rotates, the warp yarns A from the beams 18 pass through the sizing unit 20, the drying unit 22, the separating rollers 28, and the reed 19 for sizing and drying.

After the sized yarns have been wound on the drum 24 for a required number of sections, the drum 24 is removed with the carriage 29. The warp yarns on the drum 24 are then rewound by means of a known rewinder to form a loom beam. This completes the second operation.

Because the lease cord 15 provided on the yarns at the start of winding appears at the end of rewinding, the yarns from the loom beam thus formed can be easily passed through a reed on a loom.

It will be understood that the warp yarns are cleaned before sizing because warp yarns from cheeses on a cheese creel are wound through a lease reed on a warpers beam and a lease cord is provided at the ends thereof by use of the lease reed in the first operation. This minimizes the chance of yarn breakage during sizing, thus ensuring stable sizing and increasing production efficiency remarkably.

Because a lease cord has been provided on the warpers beam in the first operation, the yarns can readily be passed through a lease reed for sizing and thus a lease cord be provided on the loom beam.

Since each warpers beam formed in the first operation represents a fraction of the entire pattern for one section, only a small number of cheeses have to be mounted on a cheese creel as compared with the prior art method. This facilitates arrangement of cheeses for pattern and increases working efficiency.

Also, since the yarns from the warpers beam are passed through a lease reed in the second operation, split rods and wet and front dividing rods can be easily inserted through the yarns.

In sizing of warp yarns for yarn dyed fabric having a solid color or simple pattern, of course, the warp yarns do not have to be passed through a lease reed, nor does a lease cord have to be provided.

Although in the preferred embodiment the warp yarns are passed through the lease reed 19 before the sizing unit 20, they may also be passed therethrough after they have run through the sizing unit 20 and the drying unit 22.

What is claimed is:

1. A method for sizing warp yarns for yarn dyed fabric comprising the steps of:

a. forming a plurality of warpers beams by the steps of:
   1. arranging a plurality of cheeses on a cheese creel which is sufficient for forming only a fraction of a predetermined pattern for one section of the fabric;
   2. winding the warp yarns from said cheeses through a first lease reed onto a beam;
   3. inserting a first lease cord through the ends of the warp yarns on said beam by use of said first lease reed just before a required length of yarns is wound thereon;
   4. cutting the warp yarns between said first lease cord and said first lease reed to form a warpers beam with said first lease cord inserted through the yarn ends thereon;

b. mounting on a beam creel a required number of thus formed warpers beams;

c. passing the yarns from said warpers beams through a second lease reed into parallel side-by-side relation for the predetermined pattern;

d. guiding the warp yarns by means of said second lease reed through a sizing unit, a drying unit and separating rollers and onto a winding drum with the warp yarns from the respective warpers beams in side-by-side relation;

e. mounting said second lease reed on a reed holder provided between said separating rollers and said winding drum;

f. inserting a second lease cord through the ends of the warp yarns by use of said second lease reed before starting winding on said winding drum;

g. running the warp yarns through said sizing unit and said drying unit for sizing and winding said sized and dried warp yarns on said winding drum in the aforementioned side-by-side relation; and h. rewinding said sized and dried yarns on a beam by means of a rewinder to form a loom beam with said second lease cords at the ends of yarns.

2. A method according to claim 1 wherein the warp yarns are split by split rods into sheets and divided by wet and front dividing rods.

3. A method according to claim 1 wherein the passing of the warp yarns from said warpers beams through said second lease reed is done on a spare beam creel.

4. A method according to claim 1 wherein the warp yarns are passed through said second lease reed after they have been guided through said sizing unit, drying unit and separating rollers.

* * * * *